United States Patent [19]

Chittleborough

[11] Patent Number: 4,503,961

[45] Date of Patent: Mar. 12, 1985

[54] COIN HANDLING DEVICE

[75] Inventor: Michael Chittleborough, Berkhamsted, England

[73] Assignee: Mars Incorporated, McLean, Va.

[21] Appl. No.: 448,004

[22] Filed: Dec. 8, 1982

[30] Foreign Application Priority Data

Dec. 10, 1981 [GB] United Kingdom ..... 8137249

[51] Int. Cl.[3] ..... G07F 1/04

[52] U.S. Cl. ..... 194/1 C; 194/1 K

[58] Field of Search ..... 194/1 C, 1 D, 1 K, DIG. 28, 194/DIG. 29, DIG. 27, 102; 133/3 R; 209/605, 655

[56] References Cited

U.S. PATENT DOCUMENTS

| | | | |
|---|---|---|---|
| 1,274,261 | 7/1918 | Grover et al. | 194/1 D |
| 3,640,367 | 2/1972 | Noetinger . | |
| 3,916,922 | 11/1975 | Prumm . | |
| 4,106,610 | 8/1978 | Heiman . | |
| 4,263,924 | 4/1981 | Johnson | 194/102 X |

FOREIGN PATENT DOCUMENTS

| | | |
|---|---|---|
| 1043558 | 9/1966 | United Kingdom . |
| 1066389 | 4/1967 | United Kingdom . |
| 1415559 | 11/1975 | United Kingdom . |
| 1559577 | 1/1980 | United Kingdom . |

*Primary Examiner*—Stanley H. Tollberg

*Attorney, Agent, or Firm*—Davis Hoxie Faithfull & Hapgood

[57] ABSTRACT

A coin handling device (1) for guiding coins selectively along different paths according to denomination or type. The coin handling device comprises essentially a rectangular slab-like coin guiding element (5) pivotally mounted about a horizontal axis within a main body (4) and provided with actuating means (15, 18) operable to move the element (5) selectively into different working positions. In use, coins travelling downwardly through a vertical coin chute (23) will pass through a passage extending through the coin guiding element (5) when the element is in its central, upright position. In each of the other positions of the element (5), one or other of its rectangular faces (25) is positioned transversely in the path of coins from the vertical chute (23), so as to deflect and re-direct the coins along second or third paths. The coin handling device is capable of enabling coins to be guided along a selected path with the minimum height requirement and with only a single movable coin-guiding element (5).

14 Claims, 7 Drawing Figures

COIN HANDLING DEVICE

FIELD OF THE INVENTION

This invention relates to a coin handling device for the selective guiding of coins. Throughout this specification, "coins" shall be taken to include authentic coins belonging to any coin set of any country, tokens, false coins, slugs, washers or anything similar inserted into any coin-handling machine in an attempt to operate it.

BACKGROUND OF THE INVENTION

Coin validators are well known in which each coin inserted into an automatic slot machine is subjected to one or more tests for authenticity and denomination. The validator produces output signals according to the results of the tests which selectively control one or more gates to direct the tested coins into appropriate passageways for rejected coins, for accepted coins, and for coins of particular denominations.

An example of such a validator is disclosed in U.S. Pat. No. 3,916,922 in the name of Georg Pruemm where a succession of gates, controlled by signals produced by the validator, direct coins into appropriate passages according to the test results. It will be appreciated that a particular height requirement exists in order to accommodate the several gates. In addition, one of the gates is a 3-way gate employing two movable flaps and separate actuating elements. Also, the design of the 3-way gate would not be suitable for adaptation to four (or more) -way operation.

Coin-operated gaming machines are an example where a comparatively small height exists for accommodating any coin directing gates, owing to the comparatively long vertical coin storage tubes which are required to accommodate an adequate number of coins to be able generally to pay out against wins, which can sometimes be substantial, achieved by customers without running out of coins. In a known form of gaming machine designed for the U.K. market, no coin directing gates are employed and instead the machine will accept 10p coins, 10p tokens and 50p coins in separate inlet slots leading to individual coin validators for the different coin types. Accepted 10p coins and tokens are directed to two upwardly open receiving chutes for 10p coins and 10p tokens, respectively, forming part of a payout mechanism. Acceptable 50p coins are guided to a cashbox in the bottom of the gaming machine. Rejected 10p and 50p coins and 10p tokens are returned to a reject window accessible to the user. It will be noted that the machine has in effect three separate coin validating and handling sections which adds to complexity and cost while reducing reliability, and is more inconvenient for users because of having to select the appropriate inlet slot for each coin or token to be inserted.

SUMMARY OF THE INVENTION

The present invention is concerned with providing a gate for separating coins according to denomination which is of simple construction, can be adapted as a 4 (or more) -way gate, and, when adapted as a 3 (or more) -way gate, requires only a single coin guiding element.

A coin handling device according to the invention comprises a movable element having a through-passage therein through which coins can travel on edge, and actuating means operable to move the element selectively into at least three different working positions relative to coins arriving in use at the coin handling device along a delivery path, so that in the first working position the arriving coins travel through the through-passage to be discharged along a second path, and in the second and third positions different guiding surfaces of said element guide the arriving coins along third and fourth paths, respectively.

It will be appreciated that a 3 (or more) -way gate constructed in this way employs only the one movable element and can be designed to occupy a comparatively small height.

In a preferred embodiment, the guide surfaces of the movable element are deflecting surfaces, a different one of which is positioned transversely in the path of coins delivered along said predetermined path according to the position of the movable element, so as to re-direct such coins along the third or fourth path. Suitably, the deflecting surfaces are external surfaces of the movable element. One way of providing such external deflecting surfaces is for the movable element to be in the form of a rectangular slab which is pivotally mounted, the rectangular faces of the movable element serving as said deflecting surfaces.

In a coin handling device for handling coins delivered on a downward path, a respective sloping guide surface associated with each said path after the second, can be positioned generally below and to one side of the movable element at a larger acute angle than the corresponding deflecting surface of said element in its operative position, to the downward path of the delivered coins so that the re-directed coins slide off the side deflecting surface and onto the respective sloping guide surface to be discharged therefrom with a relatively higher horizontal component of velocity than its vertical component. This is particularly desirable for presenting coins to the top of one or more coin storage tube for stacking one on top of another with minimum risk of coin jams occurring. The actuating means may comprise, conveniently, a swing plate, mounted to turn about a pivot axis, which is linked at one end to the movable element, and a pair of solenoids arranged one at each side of the swing plate, the solenoids being selectively energisable so that their armatures can act against the hinged plate to cause said movable element to assume its first, second or third working position according to whether neither, a first one, or the other of the solenoids is energised. For accurately positioning the movable element in its first working position, the coin handling device may further comprise a centring device in the form of a pair of spring-loaded plungers on opposite sides, respectively, of the swing plate which, in their released positions, are held under the bias of their springs with their ends separated by a spacing equal to the thickness of the movable plate plus a very small clearance.

In another embodiment, the actuating means is operable to move said element into at least one further working position in which one of the deflecting surfaces of said element is positioned transversely in the path of coins discharged from the chute at a larger angle than that surface is arranged when in its other operating position so as to re-direct coins along a further path. This embodiment can then function as a 4 (or more) -way gate.

In either embodiment the coin handling device may further comprise a plate formed with a coin entry slot for coins delivered along said predetermined path. The coin handling device would then be mounted with its entry slot aligned with coin delivery means so that the movable element can guide the delivered coins selectively to the appropriate coin discharge paths.

The coin handling device when having three working positions is especially suitable for a gaming machine comprising a coin entry slot for receiving coins of three different kinds, namely coins of a first denomination, coins of a higher denomination and tokens of a particular denomination, and a coin validator arranged to check whether each coin is inserted into the slot is an authentic coin of one of the said three different kinds, the coin handling device being located in the path of acceptable coins downstream of the validator and being controlled by the validator in dependence upon the test results so that the movable element of the coin handling device will assume selectively its first working position for coins of said higher denomination so as to guide such coins to a cash box and its second or third working position for coins of said first denomination or for said tokens respectively so as to guide such coins to different coin storage tubes of a coin payout mechanism.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF EMBODIMENTS

Figure 1:
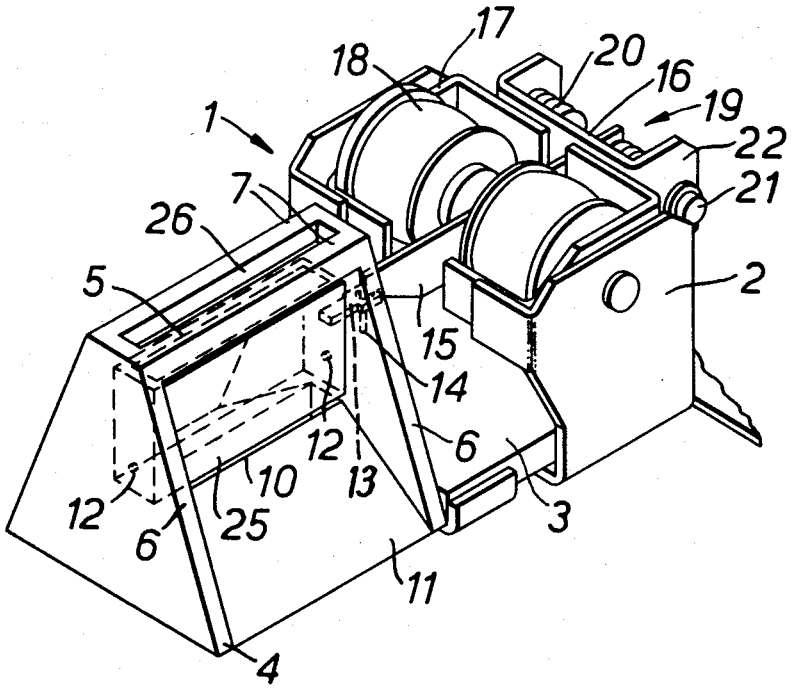
FIG. 1 is a general perspective view of one form of 3-way gate or coin handling device in accordance with the invention.

Referring to FIGS. 1 to 5, there is shown a selective coin handling or gate device 1 which comprises essentially a solenoid actuating device 2 mounted on a base plate 3 forming part of a main body unit 4 carrying a rectangular slab-like coin guiding element 5.

The body unit 4 comprises spaced apart, triangular, end flanges 6 interconnected at the top by a plate 7, having an elongate slit 26 therein through which a coin can pass on edge, and at the bottom by prismatic-section blocks 9 which are spaced apart from one another so as to define a vertical passage 10 between them and which provide upper, downwardly sloping, guide surfaces 11. Reference numeral 8 designates the coin denomination of largest size for which the gate device 1 is designed. Positioned between the plate 7 and the top of the vertical passage 10 is the coin guiding element 5 which is pivotally mounted at its lower end on stub shafts 12 rotatably supported in bores formed in the end flanges 6 so that the coin guiding element can pivot about a horizontal axis.

A lug 13 projects from one end of the coin guiding element 5 and is formed with an eye into which is loosely fitted a downwardly projecting pin 14 on the end of a horizontally extending vertically arranged swing plate 15 which extends through a fairly close fitting, slit-like, aperture in a vertical end plate 16 bolted to and extending between side support plates 17 on each of which is mounted a solenoid 18 of the actuating device 2. The two solenoids 18 can be selectively energised by driver circuits operated by output signals from the coin validator in dependence upon the validation test results.

Figure 2:
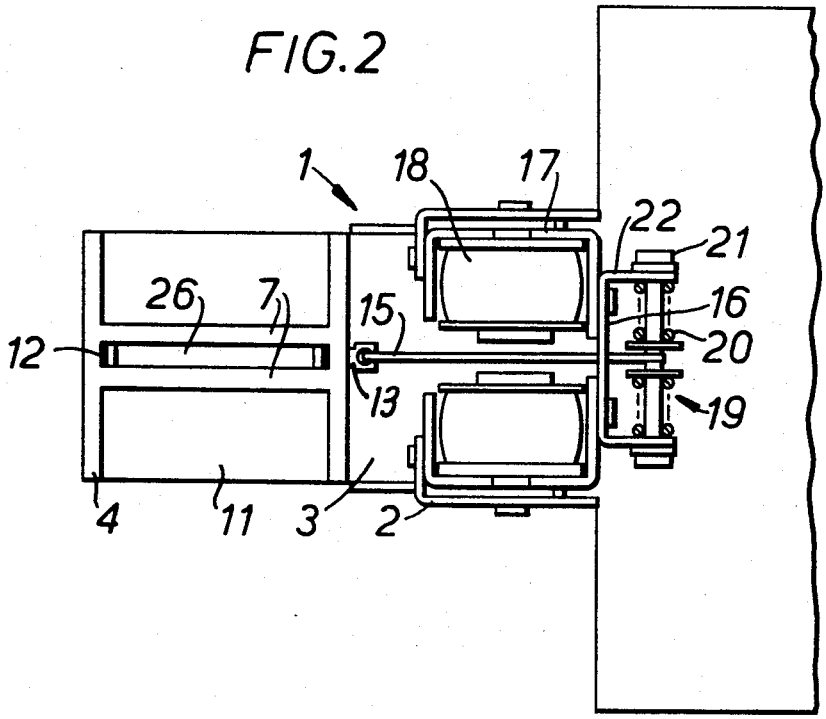
FIGS. 2 and 3 are plan views of the gate in two different working positions.

A centring device 19 is provided for centring the coin guiding element 5 in its middle upstanding, position (shown in full outline in FIG. 2). The centring device comprises a pair of spring-loaded plungers 20 on opposite sides, respectively, of the second end of the swing plate. When neither solenoid 18 is energised, the plungers adopt the position shown in FIG. 2 with their end stops 21 biassed against an end support bracket 22 of the vertical plate 16. In this position of the plungers, the separation between the adjacent ends of the two plungers is equal to the thickness of the swing plate plus a very small clearance such as 0.05 inch maximum.

Figure 3:
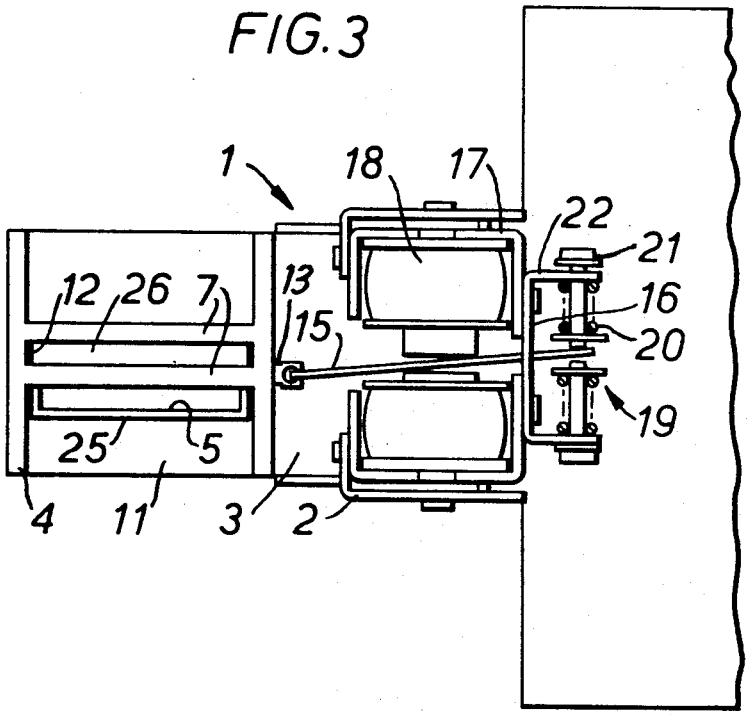
Figure 4:
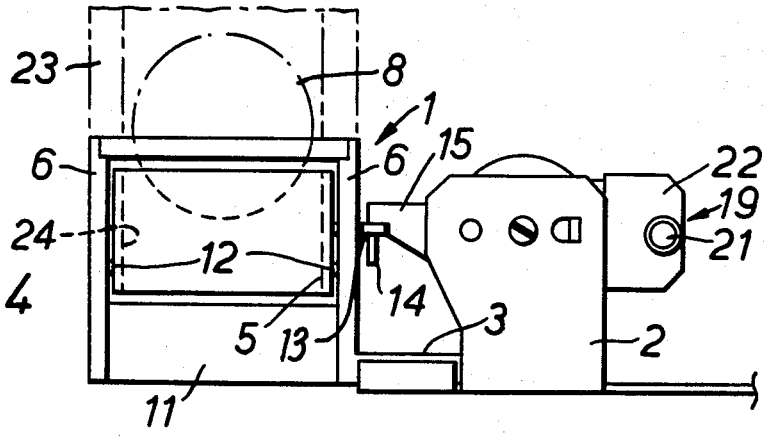
FIGS. 4 and 5 are front and end views, respectively, of the gate.

In an example of the use of the 3-way gate, it is mounted in the coin handling section of a coin validator with the slit in its plate 7 aligned with the exit end of a vertical chute 23 (FIG. 4) for acceptable coins from the validator. Unacceptable coins would be directed to a coin return window by a gate (not shown), just upstream of the acceptance chute entrance, in its reject position under the control of the validator. When neither solenoid 18 is energised so that the movable element 5 is centred by the spring loaded plungers 20, a downwardly extending coin guiding passage 24 extending through the coin guiding element 5 is aligned with the slit 26 in the top plate 7 so that coins travelling down the chute edgewise will travel through the slit, into the passage 24 and be discharged vertically downwardly from the coin guiding element 5 as indicated by arrow 29 in FIG. 5. If on the other hand one of the solenoids 18 is energised such as the upper solenoid in FIG. 3, its armature acts against the swing plate 15, causing it to pivot about its vertical pivot axis, thereby pivoting the coin guiding element 5 about the horizontal axis of its stub shafts 12, and one of the plungers 20 of the centring device is compressed by the plate 15 against the bias force of its spring. The swing plate 15 pivots until it becomes restrained by the armature of the other solenoid 18 in its end position. With reference to FIG. 3, it will be seen that in this position of the coin guiding element 5, one of its two rectangular faces 25 is positioned transversely in the path of coins discharged from the vertical chute 23. Therefore such coins are redirected by striking the deflecting surface 25 and sliding downwardly off it and onto the adjacent guide surface 11, from which they are discharged from the 3-way gate in the direction indicated by arrow 28 in FIG. 5. It is to be noted that by arranging the sloping surface 11 at a larger acute angle to the downward direction than the deflecting surface 25 of the coin guiding element 5 when the one solenoid 18 is energised, the discharged coins have a larger horizontal component of velocity than their vertical component when travelling in the direction 28. This is important when the coins are directed by the sloping guide surfaces 11 directly to the open top of a coin storage tube of a change-giving or payout mechanism in order that the coins can be stacked face-to-face one on top of another with minimum risk of coin jams.

When the energising current to the energised solenoid 18 is switched off, the depressed plunger 20 returns to its released position under the bias of its spring so as to pivot the swing plate 15 and coin guiding element 5 back into their central position.

Figure 5:
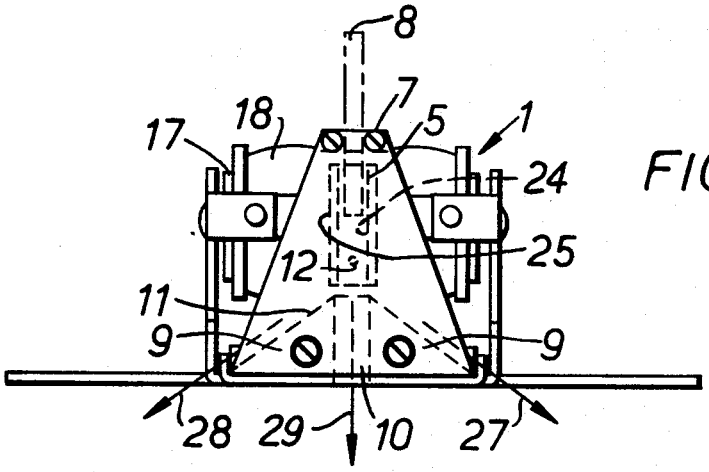

When the other solenoid 18 is energised, the 3-way gate functions in an exactly analogous manner except that the swing plate 15 and coin guiding element 5 pivot in the opposite sense so that the other side deflecting surface 25 of the coin guiding element and the other sloping surface 11 will redirect coins in the direction indicated by reference numeral 27 in FIG. 5.

It will be appreciated that the widths of the slit 26 and of the vertical chute 23, at least in the lower region, need to be sufficient to allow the unimpeded deflections of each downwardly travelling coin from the exit end of the chute, upon striking one or the other side deflecting surface of the coin guiding element 5 when in either of its sidewardly inclined positions. The main function of the plate 7 with slit 26 is to give the body unit 4 rigidity and to provide a datum position for aligning the chute 23 with the required coin delivery path to the gate device 1 during assembly. Therefore, the provision of the plate 7 is desirable, though not essential. In a modified arrangement, the coin delivery duct 23 could be positioned with its exit end at a height above the gate device 1, greater than the diameter of the largest size coin. The width of the duct 23 need then only be just sufficient for the passage of the thickest coin to be handled.

In the described arrangement of FIGS. 1 to 5 the coin deflecting surfaces are external surfaces of the element 5. However, they could alternatively be the internal surfaces defining the opposed side walls of the through passage. It will be appreciated that in this embodiment, the separation between the two side surfaces would have to be noticeably wider than the thickness of the coins to be handled or the internal deflecting surfaces flared away from one another in the region of the inlet end of the through passage, in order to allow unimpeded passage of the coin into the throughpassage when the coin guiding element is in its two sidewardly inclined positions.

Figure 6:
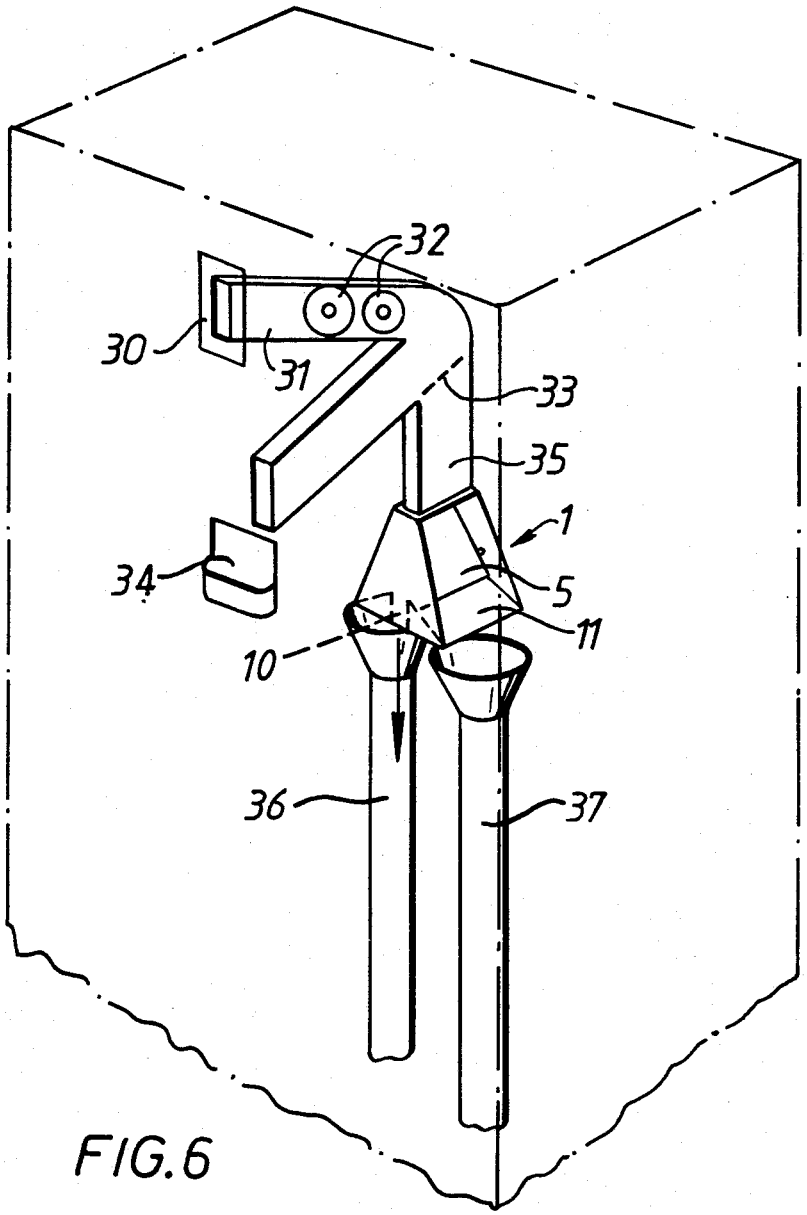
FIG. 6 is a diagrammatic, perspective, view showing the coin validating and handling sections of a gaming machine incorporating the 3-way gate depicted in FIGS. 1 to 5.

A 3-way gate of any one of the kinds described, especially the one in FIGS. 1 to 5, is suitable for use in a gaming machine for the U.K. market which has a single slot for receiving 50p coins, 10p coins and 10p tokens. The coin validating and handling sections of the gaming machines are shown very diagrammatically in FIG. 6. As can be seen coins inserted on edge through a coins entry slot 30 follow a predetermined path along a downwardly inclined ramp 31 of a validator section where each coin is tested for authenticity and denomination by one or more inductive sensors 32 controlling the operation of an accept/reject gate 33 indicated very generally by reference numeral 33. Unacceptable coins are rejected by the gate 33 and returned to the user via a reject window 34. Acceptable coins on the other hand are guided by the accept/reject gate into a vertical chute 35 at the lower end of which is positioned a gate device 1 as described above. Two coin storage tubes 36, 37 of a payout mechanism are positioned generally below the gate body and on opposite sides of it so that coins sliding off the sloping guide surfaces 11 will enter into one or other of the storage tubes according to coin type. 10p coins are collected in one of the storage tubes while 10p tokens are collected in the other one. 50p coins on the other hand are directed downwardly through the vertical passage 10 and fall therefrom through free space into a cash box (not shown) at the bottom of the gaming machine. It will be appreciated that in this application of the gate device, the single gate can handle the coin directing needs for the three different kinds of coin which are to be accepted and this avoids having to use a 50p validator for validating 50p coins inserted into a slot in one side of the machine and further validators for 10p coins and 10p tokens at the other side of the machine, as occurs in gaming machines in use at the present time. In addition, the overall height requirement of the gate, which is so critical in gaming machines, is reduced through avoiding having to employ two 2-way gates in series. Moreover, only the single movable element 5 is necessary for guiding the coin selectively into three different final directions.

Figure 7:
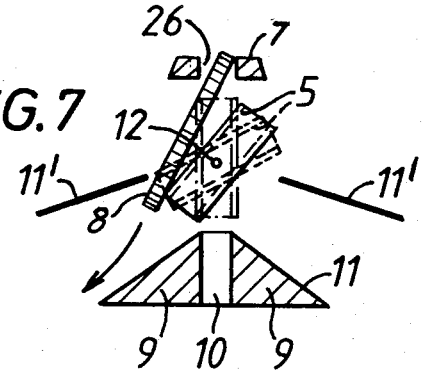
FIG. 7 is a diagrammatic end view of a 5-way gate.

With reference to the modification shown in FIG. 7 in which only the minimum of components is depicted, the gate has four or more working positions which necessitates the use of an actuating device 2 able to pivot the coin guiding element 5 selectively into at least one further position than the three described and at least one further sloping guide surface 11' at an even larger acute angle to the downward direction than the surfaces 11. In this case the horizontal pivot axis of the coin guiding element 5 needs to be spaced sufficiently above its lower edge in order that the coins can be guided onto the guide surfaces 11, 11' which are at different levels.

From the FIG. 7 embodiment, it will be appreciated that the invention also contemplates a coin handling device having a movable element, (with or without a coin guiding passage extending through it) which has at least one deflecting surface which, in different working positions of the movable element, is arranged at different angles in the path of the arriving coins, so as to direct the coins along different paths.

In accordance with a development, at least two gates of one of the constructions as described above can be arranged in series. For example, two 3-way gates according to FIGS. 1 to 5, suitably with the middle discharge path of the upstream gate leading to the entrance to the downstream gate, would then be able to separate coins according to five different denominations.

I claim:

1. A coin handling device comprising a movable element having a through-passage therein through which coins can travel on edge, and actuating means electrically operable to move the element selectively into at least three different working positions relative to coins arriving, in use, at the coin handling device along a delivery path, so that in the first working position the arriving coins travel through the through-passage to be discharged along a second path, and in the second and third positions different external surfaces of the movable element guide the arriving coins along third and fourth paths, respectively.

2. A coin handling device according to claim 1, wherein the movable element is in the form of a rectangular slab which is pivotally mounted, the external rectangular faces of the movable element serving as said deflecting surfaces.

3. A coin handling device according to claim 1, for handling coins delivered on a downward path to the coin handling device, wherein a respective sloping guide surface associated with each said path after the second is positioned generally below and to one side of the movable element at a larger acute angle than the corresponding deflecting surface of said element in its operative position, to the downward path of the delivered coins so that the re-directed coins slide off the side deflecting surface and onto the respective sloping guide surface to be discharged therefrom with a relatively higher horizontal component of velocity than its vertical component.

4. A coin handling device according to any one of claim 1, wherein the actuating means comprises a swing plate, mounted to turn about a pivot axis, which is linked at one end to the movable element, and a pair of solenoids arranged one at each side of the swing plate, the solenoids being selectively energisable so that their armatures can act against the hinged plate to cause said movable element to assume its first, second or third working position according to whether neither, a first one, or the other of the solenoids is energised.

5. A coin handling device according to claim 1, wherein the actuating means is operable to move said element into at least one further working position in which one of the deflecting surfaces of said element is positioned transversely in the path of coins discharged from the chute at a larger angle than that surface is arranged when in its other operative position so as to re-direct coins along a further path.

6. A coin handling device according to claim 1, further comprising a plate formed with a coin entry slot for coins delivered along said predetermined path.

7. A coin handling device according to claim 4, further comprising a centring device in the form of a pair of spring-loaded plungers on opposite sides, respectively, of the swing plate which, in their released positions, are held under the bias of their springs with their ends separated by a spacing equal to the thickness of the movable plate plus a very small clearance.

8. A gaming machine comprising a coin entry slot for receiving coins of three different kinds, namely coins of a first denomination, coins of a second denomination and coins of a third denomination, a coin validator arranged to check whether each coin inserted into the slot is an authentic coin of one of the said three different kinds, and a coin handling device, comprising a movable element having a through-passage therein through which coins can travel on edge, and actuating means electrically operable to move the element selectively into at least three different working positions relative to coins arriving, in use, at the coin handling device along a delivery path, so that in the first working position the arriving coins travel through the through-passage to be discharged along a second path, and in the second and third positions different external surfaces of the movable element guide the arriving coins along third and fourth paths, respectively, the coin handling device being located in the path of acceptable coins downstream of the validator and being controlled by the validator in dependence upon the test results so that the movable element of the coin handling device will assume selectively its first working position for coins of said second denomination so as to guide such coins to a cash box and its second or third working position for coins of said first denomination or for coins of said third denomination respectively so as to guide such coins to different coin storage tubes of a coin payout mechanism.

9. A coin handling device according to claim 8, wherein the movable element is in the form of a rectangular slab which is pivotally mounted, the external rectangular faces of the movable element serving as said deflecting surfaces.

10. A coin handling device according to claim 9, for handling coins delivered on a downward path to the coin handling device, wherein a respective sloping guide surface associated with each said path after the second is positioned generally below and to one side of the movable element at a larger acute angle than the corresponding deflecting surface of said element in its operative position, to the downward path of the delivered coins so that the re-directed coins slide off the side deflecting surface and onto the respective sloping guide surface to be discharged therefrom with a relatively higher horizontal component of velocity than its vertical component.

11. A coin handling device according to claim 10 wherein the actuating means comprises a swing plate, mounted to turn about a pivot axis, which is linked at one end to the movable element, and a pair of solenoids arranged one at each side of the swing plate, the solenoids being selectively energisable so that their armatures can act against the hinged plate to cause said movable element to assume its first, second or third working position according to whether neither, a first one, or the other of the solenoids is energised.

12. A coin handling device according to claim 11, further comprising a centring device in the form of a pair of spring-loaded plungers on opposite sides, respectively, of the swing plate which, in their released positions, are held under the bias of their springs with their ends separated by a spacing equal to the thickness of the movable plate plus a very small clearance.

13. A coin handling device according to claim 8 wherein the actuating means is operable to move said element into at least one further working position in which one of the deflecting surfaces of said element is positioned transversely in the path of coins discharged from the chute at a larger angle than that surface is arranged when in its other operative position so as to re-direct coins along a further path.

14. A coin handling device according to claim 8, further comprising a plate formed with a coin entry slot for coins delivered along said predetermined path.

* * * * *

UNITED STATES PATENT AND TRADEMARK OFFICE

CERTIFICATE OF CORRECTION

PATENT NO. : 4,503,961

DATED : March 12, 1985

INVENTOR(S) : Michael Chittleborough

It is certified that error appears in the above—identified patent and that said Letters Patent is hereby corrected as shown below:

Col. 7, line 3 (claim 4), delete "any one of".

Signed and Sealed this

*Twentieth* Day of *August 1985*

[SEAL]

*Attest:*

DONALD J. QUIGG

*Attesting Officer* *Acting Commissioner of Patents and Trademarks*